US008565635B2

(12) United States Patent
Yamada

(10) Patent No.: US 8,565,635 B2
(45) Date of Patent: Oct. 22, 2013

(54) PRINTING DEVICE AND APPARATUS FOR SWITCHING DISCHARGE TRAYS

(75) Inventor: Akihiro Yamada, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 207 days.

(21) Appl. No.: 13/072,360

(22) Filed: Mar. 25, 2011

(65) Prior Publication Data

US 2012/0045242 A1 Feb. 23, 2012

(30) Foreign Application Priority Data

Aug. 19, 2010 (JP) ..... 2010-184335

(51) Int. Cl.
*G03G 15/00* (2006.01)

(52) U.S. Cl.
USPC ..... 399/85

(58) Field of Classification Search
USPC ..... 399/85, 405
See application file for complete search history.

(56) References Cited

U.S. PATENT DOCUMENTS

| | | | |
|---|---|---|---|
| 5,960,247 | A | 9/1999 | Morikawa |
| 6,671,472 | B2 | 12/2003 | Shimizu et al. |
| 7,577,396 | B2 | 8/2009 | Kitano |
| 2003/0030836 | A1 | 2/2003 | Maekawa |
| 2005/0285334 | A1 | 12/2005 | Sato et al. |
| 2008/0013127 | A1 | 1/2008 | Ohkawa et al. |

FOREIGN PATENT DOCUMENTS

| | | | |
|---|---|---|---|
| EP | 0 931 745 | A2 | 7/1999 |
| JP | HEI 9-272659 | A | 10/1997 |
| JP | 10-143021 | A | 5/1998 |
| JP | HEI 11-105383 | | 4/1999 |
| JP | 2001-096877 | A | 4/2001 |
| JP | 2001-213025 | | 8/2001 |
| JP | 2002-366316 | | 12/2002 |
| JP | 2003-122526 | | 4/2003 |
| JP | 2003-246102 | | 9/2003 |
| JP | 2003-266893 | | 9/2003 |
| JP | 2003-312098 | | 11/2003 |
| JP | 2003-320732 | A | 11/2003 |
| JP | 2004-059268 | A | 2/2004 |
| JP | 2004-175043 | | 6/2004 |
| JP | 2004-258257 | A | 9/2004 |
| JP | 2004-277091 | | 10/2004 |
| JP | 2005-84307 | | 3/2005 |
| JP | 2006-016130 | A | 1/2006 |
| JP | 2006-036533 | A | 2/2006 |
| JP | 2006-184713 | | 7/2006 |
| JP | 2006-213414 | A | 8/2006 |
| JP | 2007-104066 | | 4/2007 |
| JP | 2008-284722 | A | 11/2008 |

OTHER PUBLICATIONS

Notification of Reasons for Rejection dated Sep. 18, 2012 received from the Japanese Patent Office from related Japanese Application No. 2010-184335, together with an English-language translation.
Extended European Search Report and Search Opinion dated Nov. 24, 2011 from related European Patent Application No. 11159645.8.
Notification of Reasons for Rejection dated Jun. 5, 2012 received from the Japanese Patent Office from related Japanese Application No. 2010-184335, together with an English-language translation.
U.S. Official Action dated Jul. 9, 2013 from related U.S. Appl. No. 13/182,818.
Notification of Reasons for Rejection dated May 14, 2013 from related Japanese application JP 2010-166721 of corresponding U.S. Appl. No. 13/182,818 together with English translation.

*Primary Examiner* — Quana M Grainger
(74) *Attorney, Agent, or Firm* — Scully, Scott, Murphy & Presser, PC

(57) ABSTRACT

A printing device is provided with a printing unit configured to print images on sheets, a plurality of discharge trays configured to receive printed sheets, a detection unit configured to detect a switching instruction to switch among the plurality of discharge trays, and a discharge control unit. The discharge control unit stops a currently executed print job, selects one of following print jobs which does not designate a currently used discharge tray, and switches the discharge trays such that a discharge tray other than the currently used discharge tray as a selected discharge tray to be used, starts the selected one of following print job using the selected discharge tray, when the detection unit detects the switching instruction.

8 Claims, 7 Drawing Sheets

342

| JOB | USER | DISCHARGE TRAY | REGISTERED DATE/TIME |
|---|---|---|---|
| JOB 1 | A | 1 | 2010/07/20 13:00:01 |
| JOB 2 | B | 1 | 2010/07/20 13:03:26 |
| JOB 3 | C | AUTO | 2010/07/20 13:10:13 |
| JOB 4 | A | 2 | 2010/07/20 13:11:51 |
| JOB 5 | D | 3 | 2010/07/20 13:15:47 |

341

| ? | ? | ? | ? | ? |
|---|---|---|---|---|
| 1 | USED | 50 | NO | FACE DOWN |
| 2 | STANDBY | 20 | NO | FACE DOWN |
| 3 | STANDBY | 0 | NO | FACE DOWN |
| 4 | STANDBY | 200 | YES | FACE DOWN |
| 5 | STANDBY | 70 | NO | FACE DOWN |
| 6 | STANDBY | 0 | NO | FACE DOWN |
| 7 | STANDBY | 0 | NO | FACE DOWN |

FIG. 5

41

ATTENTION

NO SWITCHABLE DISCHARGE TRAY IS AVAILABLE.
CURRENT JOB IS PAUSED.

PRINTING 10/25

FIG. 6

| JOB | USER | DISCHARGE TRAY | REGISTERED DATE/TIME |
|---|---|---|---|
| JOB 1 | A | 1 | 2010/07/20 13:00:01 |
| JOB 2 | B | 1 | 2010/07/20 13:03:26 |
| JOB 3 | C | AUTO | 2010/07/20 13:10:13 |
| JOB 4 | A | 2 | 2010/07/20 13:11:51 |
| JOB 5 | D | 3 | 2010/07/20 13:15:47 |

PRINTING DEVICE AND APPARATUS FOR SWITCHING DISCHARGE TRAYS

CROSS-REFERENCE TO RELATED APPLICATION

This application claims priority under 35 U.S.C. §119 from Japanese Patent Application No. 2010-184335 filed on Aug. 19, 2010. The entire subject matter of the application is incorporated herein by reference.

BACKGROUND

1. Technical Field

Aspects of the present invention relate to a printing device which prints images on printing sheets.

2. Related Art

Recently, printing devices such as a printer, a copier, a facsimile machine, etc. have been improved so that a printing speed is significantly increased. In association with speeding-up of the printing operation, it becomes difficult to remove printed sheets collected (stacked) on a discharge tray when a continuous printing operation is performed.

In a conventional device, by switching the sheet discharge trays when the continuous printing operation is performed, the user can remove the printed sheets while the printing operation is kept performed. Alternatively, the continuous printing operation is paused to allow the user to remove the printed sheets.

SUMMARY

When the sheet discharge trays are switched, however, the destinations (i.e., the sheet discharge trays to be used) may be changed when a single print job is being executed, and the printed sheets are discharged to separate trays. Therefore, the user can remove the printed sheets from separate trays, and it becomes necessary for the user to check the order of the sheets and the like. When the printing operation is paused, no printing operation is executed when the printing operation is paused, which may reduce productivity.

In consideration of the above, aspects of the invention provides an improved printing device with which the reduction of productivity is suppressed, while the user can remove the printed sheets with allowing the continuous printing operation.

According to aspects of the invention, there is provided a printing device which is provided with a printing unit configured to print images on sheets, a plurality of discharge trays configured to receive printed sheets, a detection unit configured to detect a switching instruction to switch among the plurality of discharge trays, and a discharge control unit which stops a currently executed print job, selects one of following print jobs which does not designate a currently used discharge tray, and switches the discharge trays such that a discharge tray other than the currently used discharge tray as a selected discharge tray to be used, starts the selected one of following print job using the selected discharge tray, when the detection unit detects the switching instruction.

BRIEF DESCRIPTION OF THE ACCOMPANYING DRAWINGS

FIG. 5 schematically shows data structure of a database storing tray information.

FIG. 6 shows an example of an information window which is displayed when a switchable discharge tray is not found.

Figures 7, 8:
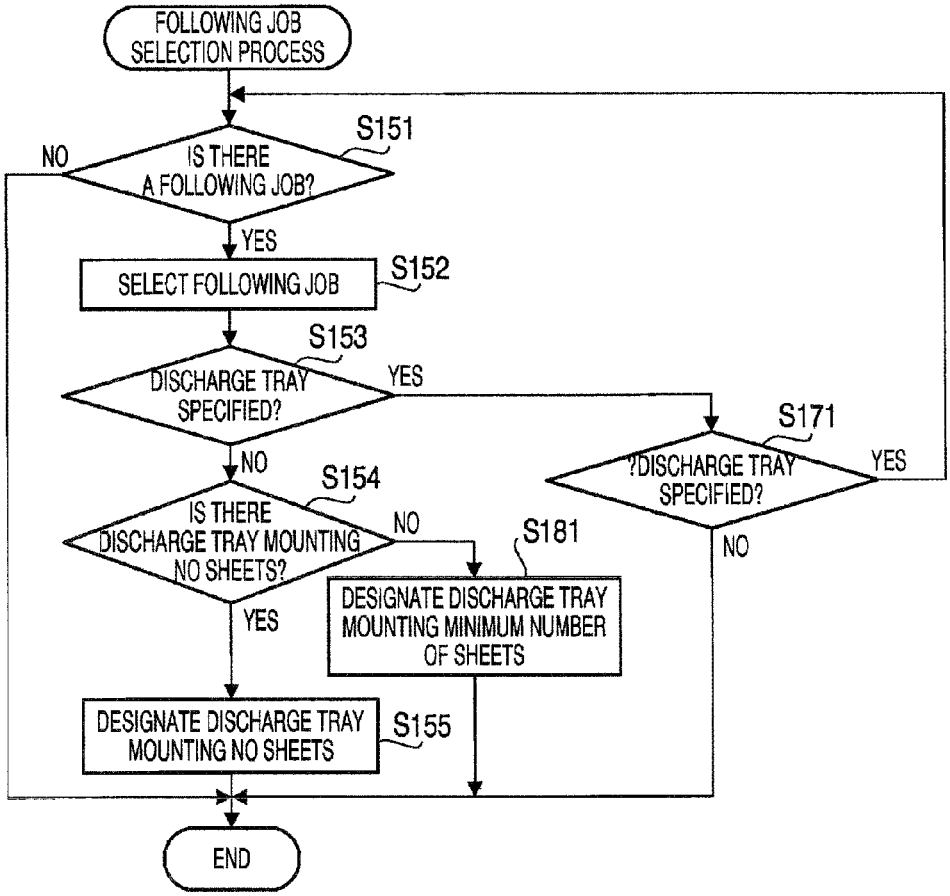

FIG. 7 is a flowchart illustrating a following job selecting process according to the embodiment of the invention.

FIG. 8 illustrates job cue registration information according to the embodiment of the invention.

Figure 9:
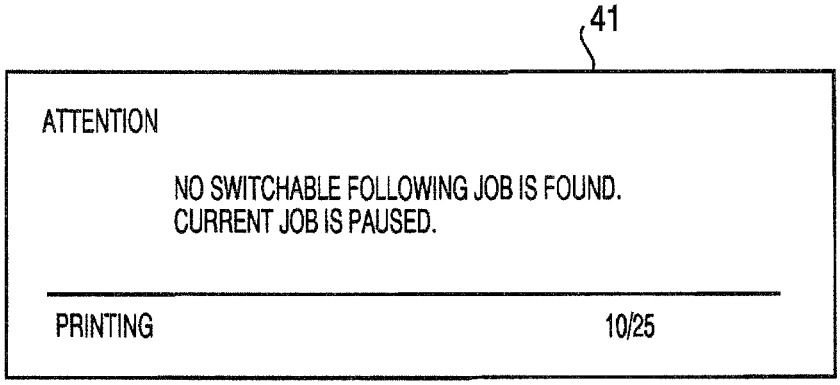

FIG. 9 shows an example of an information window which is displayed when a switchable following job is not found.

DETAILED DESCRIPTION

Hereinafter, an exemplary embodiment according to aspects of the present invention will be described with reference to the accompany drawings. Specifically, an electrophotographic printer capable of performing a high-speed printing will be described.

A printer 100 according to an embodiment has a main unit 10 at which images are printed on recording sheets, and expanded sheet discharge unit 20 provided with a plurality of sheet discharge trays on which printed sheets are discharged. The main unit 10 has a process cartridge serving as a print engine inside a cover 11. The expanded sheet discharge unit 20 is detachably coupled to the main unit 10 on its upper surface.

The main unit 10 ha a sheet feed cassette 91 which accommodates unprinted recording sheets. It should be noted that more than one sheet feed cassette 91 may be provided. For example, below the sheet feed cassette 91, auxiliary sheet feed cassette may be attached. According to the embodiment, the main unit 10 has a sheet discharge tray 93, on which printed sheets are discharged in a face-down manner, is formed on its upper surface.

On a front surface of the main unit 10, a multi-purpose tray 94 is provided. With use of the multi-purpose tray 94, manual feed of recording sheets can be done. The multi-purpose tray 94 is arranged to be openable/closeable with respect to a cover 11 of the main unit 10. Specifically, the multi-purpose tray 94 is rotatable about an axis provided to a lower side portion. When the multi-purpose tray 94 is fully opened, the manual sheet feed can be performed with use of the multi-purpose tray 94. Further, the main unit 10 is provided with a discharge tray 95, on which the printed sheets are stacked in a face-up manner. The sheet discharge tray 95 is also rotatably secured to the cover 11 of the main unit 10, and can be used as the sheet discharge tray 95 when fully opened.

On the upper face of the main unit 10, an operation unit provided with a display unit 41 having an LCD (liquid crystal display) and a button group 42 including an OK button, a cancel button, ten keys, a user authentication button, etc. is provided. In particular, the button group 42 includes a tray switch button 421 for switching discharge trays. With use of the operation panel, the user can view an operation status and/or input various commands.

Figure 1:
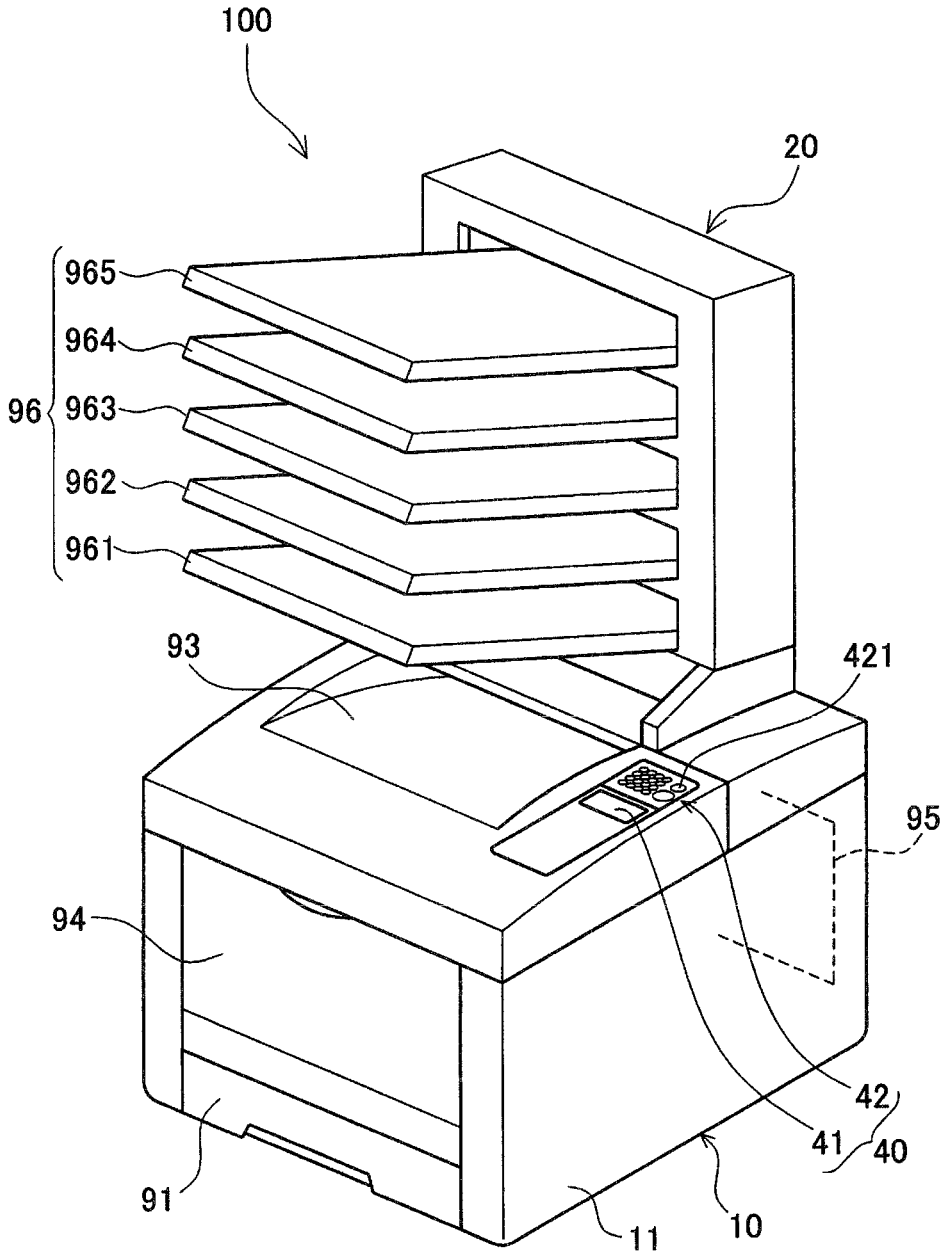
FIG. 1 is a perspective view of a printer according to an embodiment of the invention.

The expanded sheet discharge unit 20 has a five-stage discharge tray group 96. According to the embodiment, the five-stage discharge tray group 96 has discharge trays 961, 962, 963, 964 and 965, from the bottom to top (see FIG. 1). It should be noted that the discharge tray group 96 needs not be limited to the five-stage discharge trays, and the number of stages may be less than or more than five.

The main unit 10 of the printer 100 is provided with a processing unit 50 which forms a toner image in accordance with a well-known electrophotographic imaging method and transfers the toner image on the recording sheets, and a fixing device 8 which fixes the toner images transferred on the recording sheets, and rollers (e.g., a sheet feed roller 71, a register roller 72, a sheet introducing roller 74 and a sheet discharge roller 75).

The expanded discharge unit 20 has discharge rollers 761, 761, 763, 764 and 765 that feed the recording sheet to the discharge trays 961, 962, 963, 964 and 965, respectively.

Figure 2:
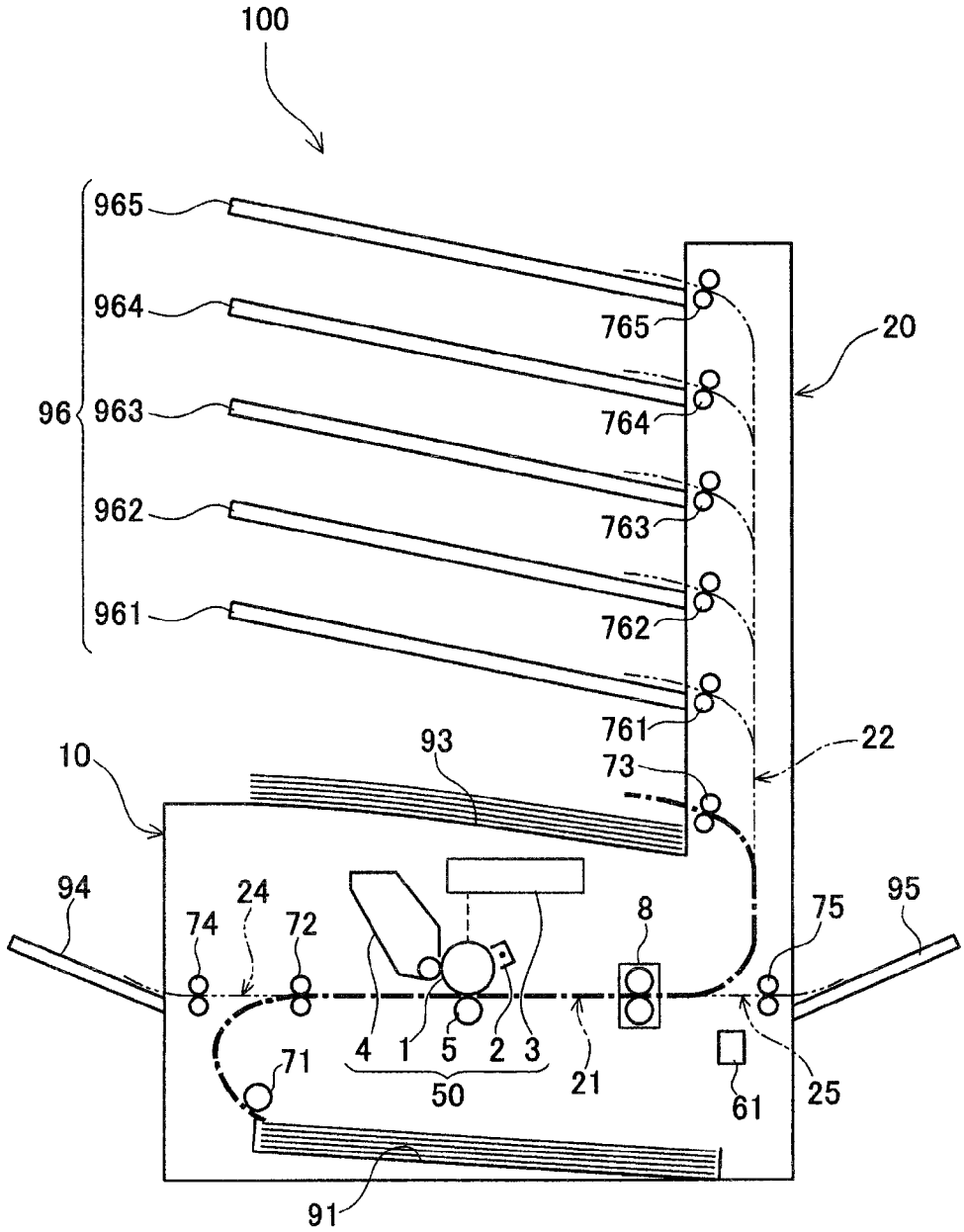
FIG. 2 is a cross-sectional side view schematically showing a mechanical configuration of the printer shown in FIG. 1.

Inside the main unit 10, a substantially S-shaped sheet feed path 21 (which is indicated by dotted lines in FIG. 2) is defined such that the recording sheets accommodated in the sheet feed cassette 91, which is located at the bottom of the main unit 10, are directed to the discharge tray 93 via the sheet feed roller 71, the register roller 72, the processing unit 50, the fixing device 8.

In the main unit 10, a substantially linear feeding path 24 is defined so that the recording sheets introduced from the multi-purpose tray 94 is fed to the processing unit 50 via the introducing roller 74. Further, in the main unit 10, a substantially linear feeding path 25 is defined so that the recording sheet passed through the fixing device 8 is directed to the discharge tray 95 via the discharge roller 75.

Inside the printer 100, a sheet feed path 22 is defined, along which the printed sheets are fed toward the expanded discharge tray unit 20 so that the printed sheets are finally directed to the intended discharge tray. Specifically, the printed sheet fed into the expanded discharge tray unit 20 are directed to the discharge tray 961 via the discharge roller 761, or directed to the discharge tray 962 (963, 964, 965) via the discharge roller 762 (763, 764, 765).

The processing unit 50 is configured to form a toner image in accordance with the well-known electrophotographic imaging process. Specifically, the processing unit 50 includes a charging unit 2 which uniformly charges the circumferential surface of the photoconductive drum 1, an exposing unit 3 which emits scanning light beam, which is modified based on an image to be formed, on the circumferential surface of the photoconductive drum 1 to form an electrostatic latent image, a developing unit 4 which applies toner to the electrostatic latent image to form a toner image, and a transfer unit 5 which transfers the toner image on the photoconductive drum 1 onto the recording sheet. The photoconductive drum 1, the charging unit 2, and the developing unit 4 are accommodated in a process cartridge, which is detachably attached to the main unit 10.

In the processing unit 50, the circumferential surface of the photoconductive drum 1 is uniformly charged by the charging unit 2. Thereafter, the charged surface of the photoconductive drum is exposed to the light beam emitted by the exposing unit 3 and a latent image is formed thereon. Then, by the developing unit 4, toner, which is a coloring agent, is supplied to the photoconductive drum 1. Then, the latent image is developed as the toner image.

The printer 100 picks up the recording sheets mounted on the sheet feed cassette 91 or the fed from the multi-purpose tray 94, one by one, and feeds the recording sheet to the processing unit 50. Then, the toner image formed on the photoconductive drum 1 is transferred onto the recording sheet by the transfer unit 5. The recording sheet bearing the toner image is fed to the fixing unit 8, where the toner image is heated and fixed onto the recording sheet. Then, the recording sheet, on which the toner image is fixed, is discharged on the discharge tray that is designated in the print job.

According to the embodiment, the printer 100 has an R/W (read/write) device 61 configured to detect an RFID (radio frequency identification) tag within a predetermined area around the printer 100 and read/write data from/to the detected RFID tag. It should be noted that the R/W device 61 is arranged to access the RFID tag of the recording sheet on whichever discharge tray the recording sheet is stacked. In the following description, the recording sheet to which the RFID tag is attached will be referred to as an RFID sheet.

Figure 3:
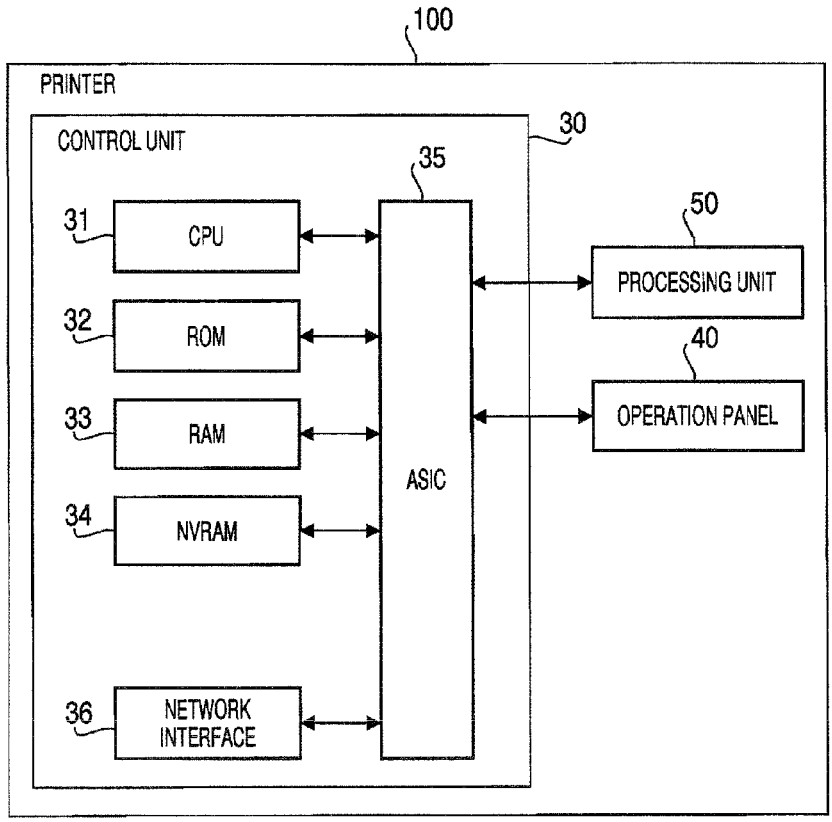
FIG. 3 is a block diagram schematically showing electrical configuration of the printer shown in FIG. 1.

Next, the electrical configuration of the printer 100 will be described. The printer 100 has a control unit 30 which is provided with a CPU 31, a ROM 32, a RAM 33, an NVRAM (non-volatile RAM) 34, an ASIC (application specific integrated circuits) 35, and a network interface 36 (see FIG. 3). The control unit 30 is electrically connected with the processing unit 50, the operation panel 40, the main unit 10, and driving motors for driving the rollers in the expanded discharge unit 20.

The CPU 31 controls the entire operation of the printer 100 by executing various functions including a function of allowing a user to remove printed sheets during the continuous printing, which will be described below. The ROM 32 stores control programs to be executed by the CPU 31 to control the printer 100, and various setting values, initial values and the like. The RAM 33 is used for a working area when the control programs are executed by the CPU 31, and for a temporary storage area for temporarily storing image data. The NVRAM 34 is a non-volatile memory and stores various setting values and/or image data.

The CPU 31 controls each unit via the ASIC 35 in accordance with the control programs and signals transmitted by the sensors, with storing the operational results in the RAM 33 and/or NVRAM 34.

The network interface 36 is connected to a network such as the Internet, and enables information processing devices such as a personal computer (PC) to connect with the network. Through the network interface 36, jobs can be transferred.

Next, the function of allowing a user to remove the printed sheet from the printer 100 will be described. Hereinafter, this function will be referred to as a removal function. The removal function is activated when the tray switching button 421 is depressed during a printing operation is being performed.

When the printer 100 (the CPU 31) detects depression of the tray switching button 421, the printer selects one of print jobs following the currently executed print job and capable of using the discharge trays other than the discharge tray used by the currently executed print job. Then, the control pauses the currently executed print job (i.e., skips the remaining part of the currently executed print job).

With the above change of print jobs, the discharge tray on which the printed sheets are discharged are switched to another one. Thus, the printed sheets are not discharged on the discharge tray which has been used. Therefore, it becomes easier for the user to remove the sheets stacked on the discharge tray that was used before the discharge trays were switched. In other words, by changing the discharge trays on which the printed sheets are stacked, the user is given an opportunity to remove the printed sheets from the discharge tray previously used.

Figure 4:
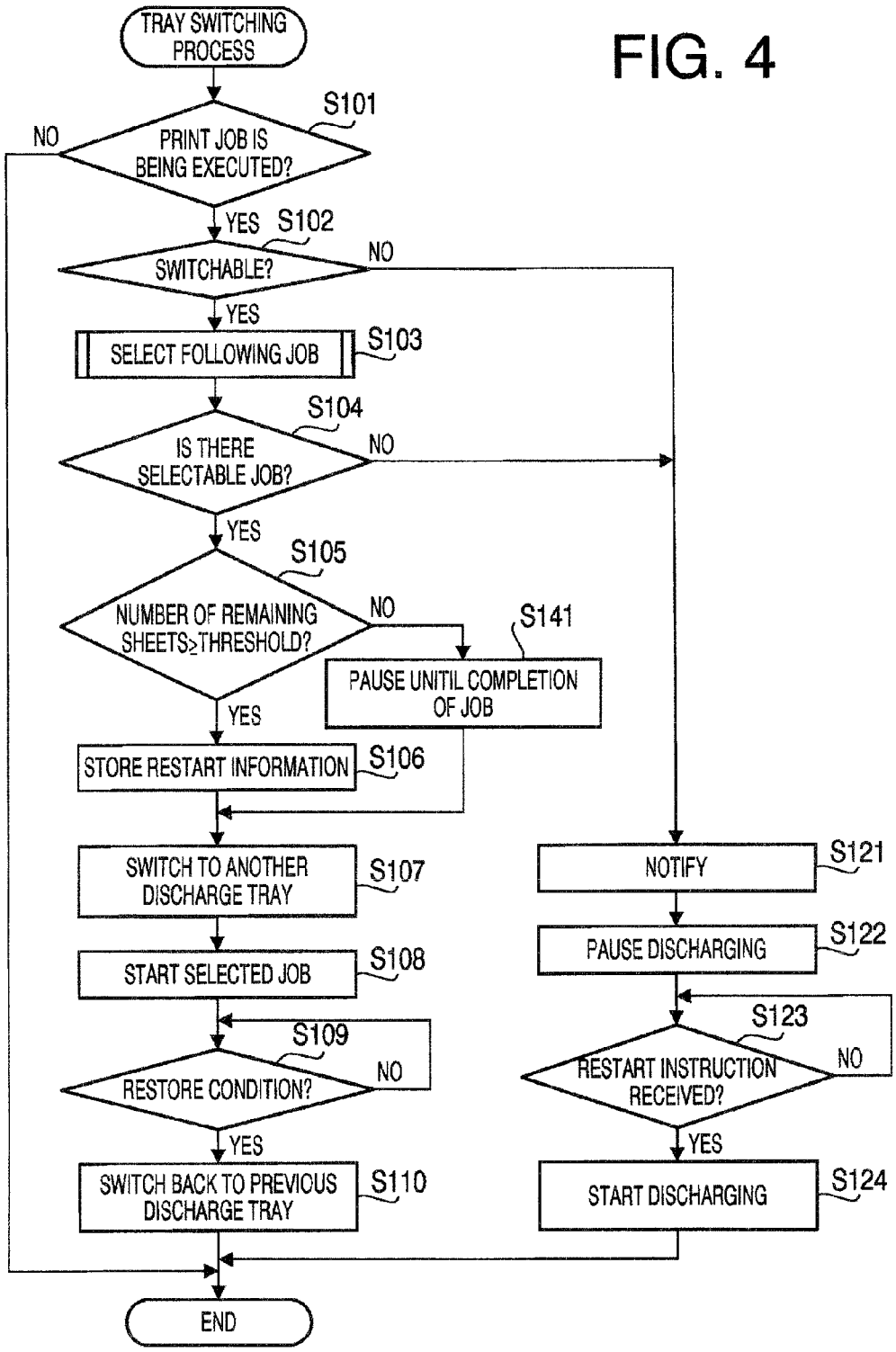
FIG. 4 is a flowchart illustrating a tray switching process according to the embodiment of the invention.

Next, the discharge tray switching process according to the embodiment will be described with reference to the flowchart shown in FIG. 4. The discharge tray switching process is evoked when the tray switching button 421 is depressed.

When the tray switching process is started, the control judges whether a print job is being executed (S101). If the printer 100 is not discharging printed sheets (i.e., if a print job is not being executed) (S101: NO), the discharge tray is not switched since the user can remove the discharged sheets, and the tray switching process is terminated.

If a print job is being executed (S101: YES), the control judges whether there is a switchable tray which is not receiving the printed sheets and can be used as the discharge tray of a new print job (S102). It should be noted that a tray on which more than a predetermined number of sheets are stacked (discharge-full state tray) cannot be regarded as the switchable tray even if it is not currently receiving the printed sheets. A face-up tray which received the printed sheets in face-up sate (i.e., with the printed face oriented upward) cannot be used as the switchable tray for a print job outputting a plurality of printed sheets. Therefore, according to the embodiment, if all the discharge trays which are not being used are in the discharge-full state or face-up tray, the control judges that no switchable tray is available. It should be noted that the judgment in S102 may be made based on one of the discharge-full state and face-up state, or in combination with another condition.

The printer 100 has a database 341 storing information regarding each of the discharge trays (see FIG. 5). The database 341 stores ID (identification) numbers (e.g., "1" for the discharge tray 93, "2" for the discharge tray 95, "3"-"7" for the discharge trays 961-965, respectively), a usage status, the current number of sheets mounted thereon, discharge full flag, a discharge type. Among such items, the usage status, the current number of sheets mounted thereon, and the discharge-full flag are updated as the printer 100 operates. In S102, the control retrieves necessary information from the database 341.

The number of discharged printed sheets on each discharge tray can be obtained with use of the R/W device 61 which counts the number of RFID sheets. Alternatively or optionally, sensors may be provided to respective discharge trays. Such sensors may be controlled to counts the discharged sheets within a predetermined period (e.g., in ten minutes for the current time). Alternatively, the number of sheets may be obtained from the print job information. The control updates the database 341 so that the number of the sheets on each discharge tray is reflected in the database 341.

If there is no switchable tray (S102: NO), the control displays a message indicating that "there is no switchable tray and the discharge tray cannot be switched" on the display 41 (see FIG. 6) in S121. Then, the control temporarily stops the currently executed print job (S122). That is, if the discharge tray cannot be switched, the currently executed discharging operation is paused. Then, the control waits for a user input to resume the print job (S123). If the user inputs a command for resuming the print job through the operation panel 40, the control resumes the print job (S124). After execution of 5124, the control terminates the discharge tray switching process.

If there is a switchable tray (S102: YES), the control executes a following job selection process to select an appropriate print job from the following print jobs registered with the job queue (S103). In the following description, the print job selected in the following job selection process is referred to as a "selected job."

In the following job selection process (see FIG. 7), the control judges whether there are print jobs following the currently executed print job (S151). For example, immediately after the following job selection process has been started, the control judges whether there is a print job immediately after the currently executed print job. In other words, the control judges whether one or more print jobs are accumulated (i.e., registered with a print queue) after the currently executed print job. If there is no following job (S151: NO), the control terminates the following job selection process without selecting a following job.

If there is a following job (S151: YES), the control selects the following job as the selected job (S152). Next, the control judges whether the selected job designates a specific discharge tray (S153).

The printer 100 has a database 342 that stores information regarding the following jobs registered with the job queue (see FIG. 8). When a print job is received, for example, from an external device, the control registers the print job with the job queue and adds information regarding the registered print job to the database 342. The database 342 stores the job name, the user name, the destination discharge tray and a time when the print job is registered with the job queue. The indication of "AUTO" in the destination discharge tray of the database 342 means that the discharge tray is to be determined automatically. The judgment in 5153 discussed above is made referring to the contents of the destination discharge tray of the database 342.

If the discharge tray is specified (S153: YES), the control judges whether the designated discharge tray is the currently used discharge tray (S171). If the currently used discharge tray is designated in the following print job (S171: YES), the control cancels the selection of the following job and returns to S151, where the control judges whether there is another print job following the previously selected print job, and repeats the steps S151 and onward. If the selected print job does not specify the currently used discharge tray (S171: NO), the control terminates the following job selection process.

If the discharge tray is not specified in the selected print job (S153: NO), the control determines a discharge tray to be used for the selected print job (S154). It should be noted that the discharge tray designated to be "AUTO" is also regarded that the discharge tray is not specified in S153.

When the discharge tray to be used for the selected print job is determined, the control firstly judges whether there is a discharge tray which is not currently receiving the printed sheets and which does not mount the printed sheets (S154). Specifically, the control refers to the database 341 and judges whether there is a discharge tray on which the number of the stacked sheets is equal to or less than a predetermined number (e.g., equal to zero).

If there is a discharge tray on which the number of stacked sheets is equal to or less than the predetermined number (e.g., no sheets are stacked) (S154: YES), the control assigns the discharge tray as the discharge tray to be used (S155). If there are a plurality of discharge trays each meets the above condition, the control assigns one having the smallest ID number as the discharge tray to be used. It should be noted that it is only an example to select the discharge tray having the smallest ID number. The control may select a discharge tray which is physically closest to the currently used discharge tray, or the control may select the discharge tray to be used at random. If there is no discharge tray mounting no sheets (S154: NO), the control selects the discharge tray on which the number of the stacked sheets is the smallest (S181). It should be noted that, when the control assigns a discharge tray in S155 or S181, the face-up discharge trays are excluded. After the discharge tray to be used is selected, the following job selection process is terminated.

In the following job selection process in S103, the control selects a print job of which the discharge tray to be used has not yet specified or a discharge tray other than the currently used discharge tray is specified as the print job to be executed.

As a result of the following job selection process (FIG. 4, S103), the control judges whether there is a selected job. If there is no selected job (S104: NO), the control displays a message (as shown in FIG. 9) indicating that the discharge tray cannot be switched since there is no following job on the display unit 41 (S121), pauses the printing operation, and awaits the user's input to resume the printing operation (S123). If the user inputs the resume command through the operation panel 40, the control resumes the printing operation (S124). After execution of S124, the control terminates the discharge tray switching process.

If there is a selected print job (S104: YES), the control obtains the number of unprinted pages of the currently executed print job (hereinafter, referred to as the number of remaining pages), and judges whether the number of remaining pages is equal to or more than a predetermined threshold value (S105).

If the number of remaining pages is less than the predetermined threshold value, the currently executed print job may be completed shortly. In such a case, even if the current print job is continued, the use would not complain since the print job is completed shortly. Therefore, according to the embodiment, the control waits for completion of the currently executed print job before switching the discharge tray (S141) if the number of remaining pages is less than the predetermined threshold value (S105: NO). With this control, the discharge tray is not switched during one print job is being executed, and therefore, when the discharge tray is switched, the printed sheets stacked on the previously used discharge tray are all the sheets for the previous print job.

If the number of remaining page is equal to or more than the predetermined number (S105: YES), it will take a relatively long period before completion of the print job. Therefore, in such a case, information necessary for resuming the print job (e.g., the last page number of the when the print job is interrupt) is stored (S106), and control proceeds to S107 without waiting for completion of the currently executed print job.

After execution of S106 or S141, the control switches the discharge tray to meet the selected print job (S107). Then, the control starts executing the selected print job (S108). Thus, by executing S107 and S108, the print jobs are switched and the discharge trays are switched.

In S109, the control judges whether resume condition is met. The resume condition is a condition for resuming the previously used discharge tray. The resume condition is, for example, removal of the printed sheets stacked on the previous discharge tray. Whether the printed sheets are removed or not is judged when the R/W device 61 counts the number of the RFID sheets. Alternatively, if a sensor (e.g., weight sensor) is provided on the discharge tray, whether the sheets are stacked or not can be detected based on the output of such a sensor. Another example of the resume condition is, for example, completion of the selected print job. Alternatively, a resume button to switch back the discharge tray may be provided on the operation panel 40. In such a configuration, the resume condition includes depression of the resume button. Alternatively, a timeout period may be defined, and the resume condition may include elapse of the timeout period.

When the resume condition is met (S109: YES), the control returns (switches back) the discharge tray (S110). By switching the discharge tray so that the previous discharge tray is used again, effect of switching of the discharge trays on another user can be avoided. If a printing operation was paused before completion and the discharge tray was switched, the control switches the discharge trays so that the previously used discharge tray is used, and further, the print job, which was paused, is resumed. Optionally, at this stage, the control may ask the user to determine whether the resumed printing operation is to be continued.

After execution of S110, the discharge tray switching process is terminated.

If it is not necessary to resume the previous discharge tray, the discharge tray switching process may be terminated after S108, without executing S109 and S110. For example, if the discharge trays are switched after execution of S141, the discharge tray was switched after completion of the previous print job. Therefore, in such a case, it is unnecessary to resume the previous discharge tray. In such a case, S109 and S110 can be skipped.

As described above, according to the printer 100, when the discharge tray switching button 421 is depressed, a print job which does use the currently used discharge tray is selected. By switching the print jobs, the discharge tray to be used is switched and output of the sheets on the previously used discharge tray is stopped. Thus, the user can remove the printed sheets stacked on the previously used discharge tray easily. Further, although the discharge trays are switched, the newly selected discharge tray does not receive the remaining pages of the previous print job, but receives the printed sheets of another (newly selected) print job which is different from the previously executed print job. Therefore, the printed sheets of a single print job are not divided into two different discharge trays. Accordingly, the user can collect the printed sheets of a print job easily. Further, according to such a configuration, when the user remove the stacked printed sheets from the previously used discharge tray, a following print job is executed using a newly selected discharge tray. Therefore, a period for which the printer 100 does not print can be reduced, which suppresses reduction of productivity.

It should be noted that the above-described configuration is of an exemplary embodiment, and can be modified in various ways without departing from the aspects of the invention. For example, the present invention can be applied not only to a printer, but also to a copier, facsimile machine, and any device that has a printing function. The image forming method of the printer needs not be limited to the electrophotographic method but other method such as ink jet method. The printer (or printing function) can be one for forming color images or monochrome (or black/white) images.

According to the above-described exemplary embodiment, the printer 100 has the extended discharge unit 20 and has seven discharge trays. However, the invention can be applied if the printer has two discharge trays. That is, if the printer (or a device having a printing function) has at least two discharge trays, the invention can be applied without implementing the extended discharge unit 20.

According to the exemplary embodiment, the discharge tray switching button 421 is used to switch the discharge trays. However, the invention needs not be limited to such a configuration, and detection of a user around the device with use of a human sensor or user authentication may be utilized for switching the discharge trays.

In the exemplary embodiment, when the switchable discharge tray is not available (S102: NO), or there is no print job to be selected (S104: NO), the control pauses the currently executed print job so that the user can remove the stacked printed sheet easily. However, this is only an example, and can be modified such that the output amount of sheets per a unit period may be reduced (i.e., the sheet discharge operation is made slower). For this purpose, the interval between fed sheets may be elongated, or the sheet feed speed may be lowered.

According to the embodiment, when the discharge trays are switched, whether the switching is effected between print jobs or immediately is determined based on the number of remaining pages of the currently executed print job (S105). This configuration can be modified such that only one of such controls is employed. That is, the switching of the discharge trays may be always done between the print jobs so that the printing sheets of the same print job from are not distributed on different discharge trays. Alternatively, the switching of the discharge trays is always done immediately regardless of the number of remaining pages so as to enable the user to remove the printed sheets immediately.

What is claimed is:

1. A printing device, comprising:

a printing unit configured to print images on sheets;

a plurality of discharge trays configured to receive printed sheets;

a detection unit configured to detect a switching instruction to switch among the plurality of discharge trays; and a processor configured to:

stop a currently executed print job, select one of following print jobs which does not designate a currently used discharge tray as a selected print job, switch the discharge trays such that a discharge tray other than the currently used discharge tray as a selected discharge tray to be used by the selected print job, start the selected print job using the selected discharge tray, when the detection unit detects the switching instruction; and reduce the number of discharged sheets per a unit time period for the currently executed print job if there is no switchable discharge tray.

2. The printing device according to claim 1, wherein the processor is configured to select, as the selected print job, the one of following print jobs in which a discharge tray mounting the printing sheets in which the number of printing sheet is less than a predetermined threshold value.

3. The printing device according to claim 1, wherein the processor is configured to switch the discharge trays between the currently executed print job and a following print job.

4. The printing device according to claim 1, wherein the processor is configured to switch the discharge trays before the currently executed print job is completed if the remaining number of pages to be printed in the currently executed print job is equal to or more than a predetermined threshold number.

5. The printing device according to claim 1, wherein the processor is configured to switch back the discharge tray to a previously used discharge tray on condition that the printed sheets are removed from the previously used discharge tray, after the discharge trays are switched from the previously used one to another.

6. The printing device according to claim 1, wherein the processor is configured to back the discharge tray to a previously used discharge tray on condition that the printed sheets are removed from the previously used discharge tray and when the currently executed print job is completed, after the discharge trays are switched from the previously used one to another.

7. A non-transitory recording medium storing a sheet discharge control program for a printer comprising a printing unit configured to print images on sheets, a plurality of discharge trays configured to receive printed sheets, and a detection unit configured to detect a switching instruction to switch among the plurality of discharge trays, wherein the program contains instructions to cause the printer to stop a currently executed print job, select one of following print jobs which does not designate a currently used discharge tray, switch the discharge trays such that a discharge tray other than the currently used discharge tray as a selected discharge tray to be used, start the selected one of following print job using the selected discharge tray, when the detection unit detects the switching instruction, and reduce the number of discharged sheets per a unit time period for the currently executed print job if there is no switchable discharge tray.

8. A printing device, comprising:

a printing unit configured to print images on sheets;

a plurality of discharge trays configured to receive printed sheets;

a detection unit configured to detect a switching instruction to switch among the plurality of discharge trays; and a processor configured to:

stop a currently executed print job, select one of following print jobs which does not designate a currently used discharge tray as a selected print job, switch the discharge trays such that a discharge tray other than the currently used discharge tray as a selected discharge tray to be used by the selected print job, start the selected print job using the selected discharge tray, when the detection unit detects the switching instruction; and reduce the number of discharged sheets per a unit time period for the currently executed print job if there is not a print job designating a discharge tray other than the currently used discharge tray.

* * * * *